United States Patent [19]

Simpson

[11] 4,030,678

[45] June 21, 1977

[54] TAPE WINDING DEVICE

[76] Inventor: Ralph E. Simpson, 2445 N. Highland Road, Upland, Calif. 91786

[22] Filed: June 18, 1976

[21] Appl. No.: 697,433

[52] U.S. Cl. ..... 242/67.2; 242/75.2

[51] Int. Cl.² ..... B65H 17/02

[58] Field of Search ..... 242/55, 55.16, 55.18, 242/67.2, 75, 75.2, 74

[56] References Cited

UNITED STATES PATENTS

| | | | |
|---|---|---|---|
| 2,066,488 | 1/1937 | Schmied | 242/67.2 |
| 2,864,609 | 12/1958 | Trimble | 242/55.18 |
| 2,943,853 | 7/1960 | Trimble | 242/55.18 |
| 2,962,240 | 11/1960 | McGayhey et al. | 242/55.18 |
| 3,094,295 | 6/1963 | Ward | 242/67.2 |

*Primary Examiner*—Leonard D. Christian
*Attorney, Agent, or Firm*—John H. Crowe

[57] ABSTRACT

A device for rapidly winding a load of paper tape from a computer into a relatively tight roll that can be fed directly to a phototypesetting machine. The device has a round deck, positioned to rotate in a horizontal plane on which are mounted three posts. The posts are equiangularly spaced around the center of the deck to serve as a hub about which the tape roll is formed. Each post has a slot to receive the tape and one end of the tape is threaded through the slot of one of the posts and bent around that post prior to the winding procedure. An electric motor then drives the deck in a spinning motion about its axis to rapidly wind the tape around the three posts. Two tension rollers are mounted at the periphery of the deck to guide the incoming tape and hold it under sufficient tension to ensure the formation of a relatively tight roll during the winding operation. To make this possible, one of the rollers is stationary and the other is spring-loaded to bear resiliently against the first so that the two rollers subject the tape to sufficient squeezing pressure to provide the proper tension for good roll formation. The outer edge of one of the hub posts on the tape deck slopes slightly towards the center of the deck from its lower end so that the tightly wound roll of tape can be slipped easily off of the hub when the winding operation is completed.

10 Claims, 5 Drawing Figures

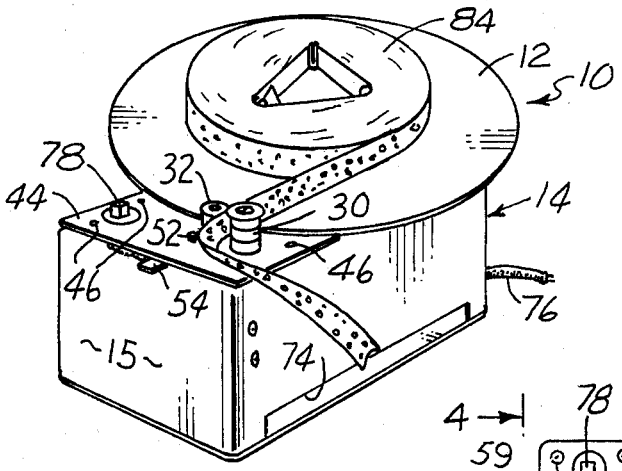
FIG. 1.
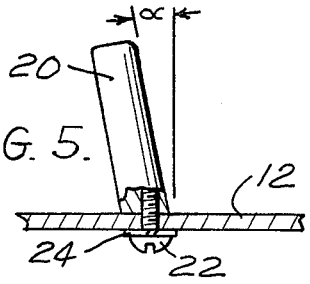
FIG. 5.
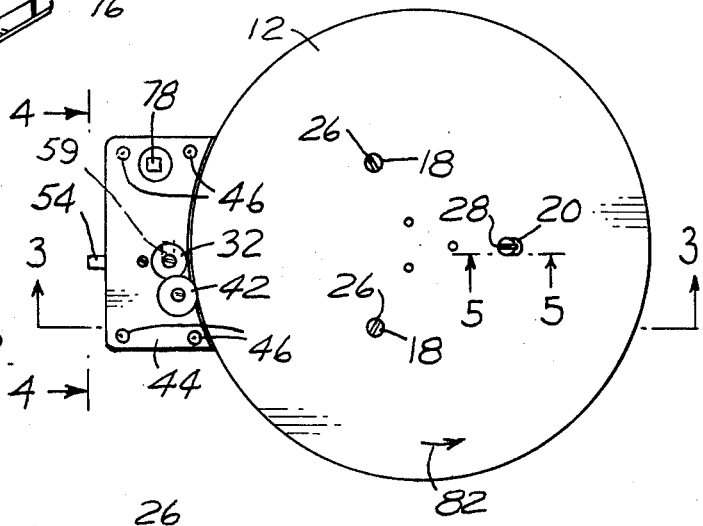
FIG. 2.
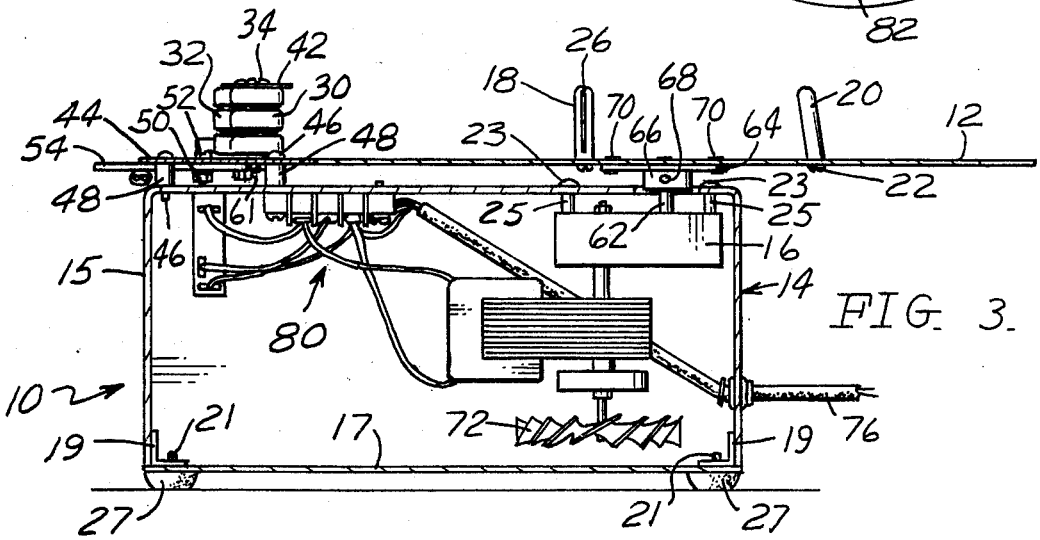
FIG. 3.
FIG. 4.
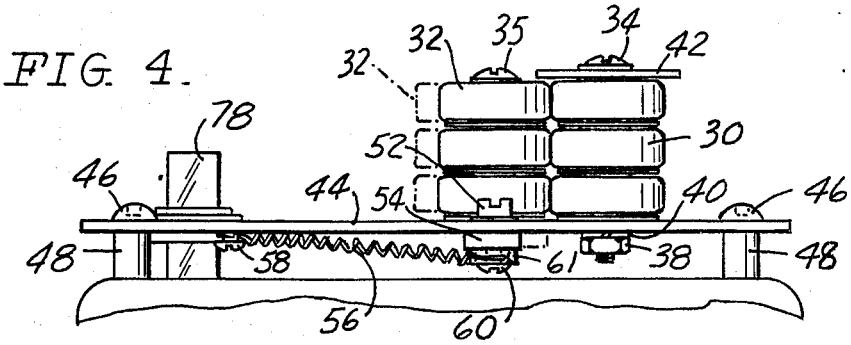

TAPE WINDING DEVICE

BACKGROUND OF THE INVENTION

This invention relates generally to tape winders, and more particularly to such winders adopted to rapidly wind dumped computer tape containing coded information into relatively tight rolls that can be fed directly to phototypesetting machines in newspaper printing plants.

Daily newspapers, and especially large metropolitan dailies, have become increasingly automated over the years. This automation involves the increasing use of computers in the processing of copy for the papers. It is now common practice in many newspaper plants to feed accumulated quantities of information to computer memory banks as one step in the processing of the information for publication. Typical of the kind of information thus committed to computers is that making up newspaper classified sections. When the time comes to retrieve this information from a computer, the normal procedure is to have the computer "dump" it loosely on the floor in the form of coder paper tape. This tape is then fed to a phototypesetting (commonly called a photocomp) machine that converts it into a photographic negative of the copy in uncoded form. This negative is then put through a processor whereby a positive picture of the copy is obtained for use in the next step of the printing process.

A computer of the above-indicated type dumps its tape fairly rapidly, in the order of 1,000 to 1,500 feet in from 15 to 20 minutes. The dumped tape piles loosely on the floor and there has theretofore been no available means for automatically processing such a large quantity of tape without interruption to prepare it for feeding to a photocomp machine. Consequently, it has been necessary to have an operator stop the computer after it has dumped from about 150 to 300 feet of the tape and feed that much of the tape by hand to a low capacity winder, after which the wound tape is fed to the photocomp machine. The operator repeats this procedure until all of the tape from the computer, normally a thousand feet or more, is fed into the photocomp machine. This is a slow, tedious process, and one which requires the constant presence of an operator to see that the tape from the computer is properly fed to the low capacity winder to prevent snarling of the tape, slippage of the tape from the winder reel or the occurrence of some other mishap. Because the operator must feed the tape from the computer to the winder by hand, the winding speed is, of necessity, slow, since otherwise the tape would load too fast for good control and the operator would run the risk of having his fingers cut by the fast moving edges of the tape. This prior art winder has a vertically mounted reel from which the tape has a tendency to slip and which accounts, at least in part, for its low tape holding capacity and the necessity of having an operator in constant attendance during operation thereof. It takes an experienced operator about half an hour to wind 1,200 feet or so of dumped tape by the above-described (conventional) method, and this accounts only for the actual winding time, to the exclusion of the time lost as a result of the requisite division of the tape into relatively short increments during the tape processing procedure.

From the foregoing it will be apparent that the conventional prior art method of feeding dumped tape from computers to the readers of photocomp machines is slow and tedious. Furthermore, that method is expensive in that it requires the constant presence of an operator to perform a routine task requiring no special skill or experience. It will therefore be appreciated by those skilled in the art that the provision of some means of handling dumped computer tape to speed up the feeding of the tape to a photocomp machine and eliminate the necessity of having an operator continually "babysit" the operation would constitute an improvement in newspaper printing technology of substantial commerical merit.

SUMMARY OF THE INVENTION

I have now provided, in the unique tape winder of this invention, a device adapted to automatically wind 1,000 or more feet of dumped tape from a computer into a tight roll which can thereafter be fed without interruption to a photocomp machine. The winder operates at a relatively high speed, being capable of winding 1,200 feet of tape in from 3 to 3½ minutes. In addition to winding the tape rapidly, the winder has the capacity to receive the entire length of tape and thereby avoid the necessity of breaking and winding it in relatively short increments as required with presently conventional printing equipment.

The novel winder of this invention, in its preferred form, comprises a flat, round deck mounted to rotate in a horizontal plane, and cooperating electric motor means for driving the deck in a spinning motion about its axis. Mounted on top of the desk in equiangular relationship around its center are three upstanding hub posts, two of which have outer edges that are perpendicular with respect to the deck and the third of which has an outer edge of slants slightly toward said center from its bottom. A pair of outstanding tension rollers are mounted near the deck, adjacent its outer periphery, one being stationary and the other being spring-loaded to bear resiliently against the stationary one. The three hub posts are slotted to receive the leading end of a tape to be wound, which tape can be threaded between the tension rollers and through an appropriate slot in one of the hub posts for attachment to that post so that it can thereafter be pulled into a roll around the hub posts by the motor-driven deck. The tension rollers are positioned to properly guide the tape toward the hub posts on the rotating tape deck during operation of the winder, and they squeeze the tape with the proper amount of pressure to ensure the formation of a relatively tight roll around said hub posts.

To prepare the winder for use, the tail end of a pile dumped tape from a computer is threaded between its tension rollers and into the slot of an appropriately positioned hub post, then bent around the post so that it can be pulled thereby when the post starts moving. The winder is then switched on and the rotating deck and hub posts cause the tape to wind around the latter and form a roll. The horizontal position of the tape deck ensures that the roll will not fall away from the winder as it is being formed and thus permits rapid rotation of the deck without risk of tape damage or loss during the winding operation. The tension rollers guide the tape to the roll on the winder, and exert sufficient pressure thereon to keep it under the proper tension for tight roll formation, whereby no manual handling of the tape during the winding operation is required. After the roll is formed, it can be easily removed from the hub posts of the winder (in spite of its tightly wound condition) because of the slight inclination of the outer edge of one of the posts, for feeding to a photocomp machine. It will thus be seen that the novel winder of this invention makes possible the automatic winding of a thousand or more feet of dumped computer tape into a single, tightly wound roll that can be fed directly into the reader of a photocomp machine. Consequently, all of the above-noted disadvantages of presently conventional means of processing such tape for use in photocomp machines are eliminated through the use of my winder.

It is therefore a principal object of this invention to provide means for the rapid, automatic winding of a complete load of dumped tape from a computer into a tightly wound roll suitable for feeding to a photocomp machine.

It is another object of the invention to provide such means for processing the dumped tape that functions without the need of manual supervision during the winding operation.

Other objects, features and advantages of the invention will become apparent in the light of subsequent disclosures herein.

BRIEF DESCRIPTION OF THE DRAWING

FIG. 1 is a perspective view of a tape winder of preferred form in accordance with this invention in the process of winding dumped computer tape into a roll.

FIG. 2 is a top view of the winder, minus the roll of tape.

FIG. 3 is a longitudinal sectional view of the winder, drawn to an enlarged scale, taken along line 3—3 of FIG. 2.

FIG. 4 is a still further enlarged fragmentary view of a portion of the winder, as seen from line 4—4 of FIG. 2, showing limit positions of a movable part in solid and phantom lines, respectively.

FIG. 5 is a still further enlarged view, partly in section, of a fragmentary portion of the winder, showing a hub post forming an important part of said winder, taken along line 5—5 of FIG. 2.

DESCRIPTION OF PREFERRED EMBODIMENT

Considering now the drawing in greater detail, there is shown generally at 10 a preferred embodiment of a tape winder in accordance with this invention. The parts of tape winder 10 includes a flat, circular tape deck 12, preferably, but not necessarily, made of aluminum, a pair of tension rollers 30 and 32 and an elastic gearhead motor 16 for driving the tape deck 12. The tape deck is mounted horizontally over a housing 14 for the motor, and the tension rollers 30 and 32 are positioned adjacent the periphery of the tape deck on a platform 44 supported on the housing at the same level as the tape deck by means of four screws 46 and four cylindrical spacers 48 disposed around the screw shanks between the top of the housing and the platform in the manner depicted in FIGS. 3 and 4. The motor housing 14 is made up of an integral shell 15 and a bottom 17 (with a rubber foot 27 at each corner) removably secured to the shell by means of a pair of screws 21 passing upwardly through aligned openings in the bottom and a pair of L-shaped brackets 19 that are fixedly secured to the inner surfaces of the end walls of the shell 15, intermediate the side edges of those walls, in the manner illustrated in FIG. 3. The motor 16 is suspended underneath the right end portion of the top of shell 15 (as seen in FIG. 3) by means of two screws 23. A pair of cylindrical spacers 25 around the screws 23 hold the motor in spaced relationship with the top of the shell.

The motor 16 is positioned so that its drive shaft, shown at 62, extends vertically upwardly and into a receptive socket in the downwardly extending hub 66 of a round drive plate 64 concentrically secured to the underside of tape deck 12 by means of three rivets 70, and the drive shaft and hub are fastened together by means of a set screw 68 in the manner illustrated in FIG. 3. The top of the motor housing shell has a suitable aperture for the hub 66 to permit free rotation of the latter during operation of the tape winder.

The tension roller 30 is held in axially vertical position on the platform 44 by means of a screw 34 and a nut 38, the nut 38 being tightened against a lock washer 40 around the lower end of the screw. The tension roller 32 is mounted on the inner end of the lever 50 pivoted at 52 by nut and screw means to permit the swinging of that roller into and out of tangential contact with the stationary roller 30 for reasons soon to be evident. The lever 50 is mounted underneath the platform 44, and its outer end extends beyond the front edge of the platform, as shown at 54 in FIGS. 1, 2 and 3, to provide means for easy finger manipulation of the position of the lever and the roller 32. Lever 50 is normally held in such position as to cause tension roller 32 to bear resiliently against the stationary roller 30 by means of a spiral spring 56 secured at one end by a screw 58 fastened in an appropriate opening in the underside of platform 44. The other end of the spring 56 is affixed to lever 50 forwardly of the pivot point 52 by means of a screw 60 fastened to the underside of the lever (see FIG. 4). The tension roller 32 is positioned in axially parallel relationship with stationary roller 30 by means of a screw 35 that extends downwardly through the inner end of lever 50, and is secured in position by means of a nut 61 (see FIG. 3) similar to the nut 38 at the bottom of screw 34 for the stationary roller. Platform 44 is appropriately slotted to allow for the movement of screw 35 when lever 50 is manipulated to swing roller 32 out of contact with stationary roller 30, the resulting slot being shown in broken line outline form in FIG. 2. A washer 42 of larger diameter than the stationary roller 30 is secured in position at the top of the latter so as to extend outwardly over the area of contact of the two rollers in their normal positions of use, as illustrated in solid lines in FIG. 4. The purpose of this overlapping washer will soon be made clear.

Mounted to extend upwardly from the upper surface of the tape deck 12 and form a triangular hub around the center of that deck are two upright hub posts 18 and a slightly tilted third hub post 20, the tilt of the latter being toward the center of the tape deck (see, in particular, FIG. 5, where the angle of tilt, measuring just under 9°, is shown at $\alpha$). The three hub posts are secured in position by means of three screws 22, passing upwardly through the tape deck and into tapped bores in the lower ends of the posts, the screws being employed in conjunction with lock washers 24 that help secure them tightly in position, one such washer being shown in FIG. 5. Each of the hub posts 18 has a slot 26 extending from the top to a point near the bottom, disposed radially of the tape deck, and the inclined hub post 20 has a similar slot 28, the purpose of these slots being to permit the threading of a tape through any of the hub posts prior to use of the winder. The angle of tilt of hub post 20 from the vertical can vary from that shown, but should be slight, preferably from about 7° to about 10°, to provide enough hub slope for easy slippage of the fully formed tape roll from the hub posts but not enough to permit escape of the roll therefrom during operation of the winder.

Gearhead motor 16 is a standard 200 rpm, fractional horsepower (about 1/30-hp) motor of readily available type. The motor is provided with a ventilating fan 72, and the shell 15 of motor housing 14 has openings in its top, not shown, and an elongate opening 74 at the bottom of one side to permit good ventilation of the housing interior when the motor is running. The winder operates from a standard 110-volt AC power source, and is provided with a cable 76 having a grounded plug, not shown, for use in a conventional outlet socket. Control of the motor 16 is achieved by means of an on/off switch 78 with a built-in signal light designed to light up when the switch is on, and suitable wiring and electrical hardware, shown generally at 80 in FIG. 3, are provided for operation of the motor and switch.

To prepare winder 10 for operation, the tail end of a pile of tape dumped on the floor by a computer is placed between the tension rollers 30 and 32 (roller 32 can be swung away from roller 30 by moving the outer end 54 of lever 50 counterclockwise from its FIG. 2 position to make the tape insertion easier) and threaded through a slot in on of the posts on tape deck 12. The end of the tape is then bent or looped around the post through which it is threaded in such a way as to remain attached to the post for pulling when the winder is turned on. When switch 78 is moved to the on position, motor 16 causes the tape deck 12 to spin in the counterclockwise direction, as indicated by the arrow 82 on FIG. 2, and pull the tape around the hub posts 18 and 20. As the motor continues to run, the tape builds up in a roll around the hub posts in the manner illustrated in FIG. 1, which shows a partially formed roll at 84. The tape is guided from the pile on the floor to the roll on the tape deck of the winder by the tension rollers 30 and 32 which are positioned to steer the tape to the outer periphery of the roll on the tape deck in such position as to fall naturally against the rotating roll without twist or distortion. Additionally, the tension rollers grip the incoming strand of tape with sufficient pressure to ensure the formation of a tightly wound roll, which is desirable for high capacity loading of the winder deck. The enlarged washer 42 at the top of roller 30 overlying the space between the tension rollers through which the tape passes serves to prevent the tape from flying up out of its position between the rollers when the winder is in operation. By virtue of the relatively high speed of tape deck 12 and the tension exerted on the entering strand of tape by the tension rollers 30 and 32, an entire pile of 1,000 feet or more of dumped computer tape can be automatically wound into a single roll in short order for feeding in its entirety to a photocomp machine. For example, I have determined that 1,200 feet of such tape can be automatically wound into a tight roll by the prototype for winder 10 in 3 minutes, 10 seconds. Moreover, the roll of tape is wound with the end that came last from the computer at its center and the beginning of the computer tape on the outside, so that it can be fed directly into the reader of a photocomp machine from a suitable dispenser. Finally, the tape roll, although tightly wound, slips easily away from the hub posts on the tape deck by virtue of the slight tilt of one of the posts. This tilt is an important feature of my invention since if all of the hub posts were perpendicular to the deck the fully formed tape roll would be too tightly drawn around those posts for such easy removal from the winder.

As will now be apparent, the use of my novel winder cuts down substantially on the time necessary for the processing of dumped computer tape into a form suitable for feeding to a photocomp machine (the processing time being something like 1/10 of the time required with the use of the conventional equipment presently in use), and accomplishes this automatically and unattended by an operator. Moreover, the roll of tape from the winder can be fed to a photocomp machine from a suitable unwinder of my own design (available from TapeMatic Division of NSW INDUSTRIES, Ontario, Calif., as Unwinder Model TD-1200) in one uninterrupted operation and unattended by an operator.

While the tape deck of my novel winder can, of course, vary in size to accomodate different tape loads, I have found a preferred tape deck diameter for use in winding 1,200 or so feet of tape with ease and convenience to be about 10½ inches.

The present invention has been herein described and illustrated in considerable detail in order to comply with legal requirements for a full public disclosure of at least one of its embodiments. Such detailed disclosure is not, however, intended to unduly limit the scope of the patent monopoly sought to be granted. Accordingly, while my novel tape winder has been illustrated in what is considered to be a preferred embodiment, it is emphasized that departures may be made therefrom within the scope of my invention. Certain of these departures have already been mentioned, and others will occur to those skilled in the art in the light of present teachings. Exemplary of the latter are noncritical variations of the shapes of various parts, or features, of the winder. A more specific example of such a variation would be the substitution of an upright hub post for inclined hub post 28 having its outer side beveled to provide a slightly inclined surface of contact for the tape to permit easy removal of a tape roll from the winder.

While the foregoing description has emphasized the applicability of my novel winder for the winding of dumper computer tape in newspaper printing plants, I wish to make it clear that the winder is not necessarily limited to that particular use potential, but can be employed in any capacity for which its unique structural character and functional capabilities suit it.

In summary, the scope of the present invention, of course, includes all forms thereof encompassed by the language of the following claims.

I claim:

1. Tape winding means particularly suited for the automatic winding of a pile of loose tape dumped by a computer into a relatively tight roll, said tape winding means comprising:

a flat tape deck mounted for horizontal rotation about an axis, said tape deck having three hub posts mounted equidistantly from said axis and equiangularly spaced therearound to form a hub about which said tape can be wound, at least one of said hub posts having a vertical slot sized to receive said tape so that an end of the tape can be threadedly connected to that post to permit subsequent pulling of said tape thereby; two of the three hub posts having vertical outer sides and the other post having a tape receiving outer side that slopes slightly inwardly from the vertical, towards said axis, in the upward direction;

motor means for rotating said deck about said axis at relatively fast speed;

control means for turning said motor means on and off; and tape guide and tensioning means for guiding tape disposed for winding about said hub toward that hub in proper position for the rapid formation of said roll therearound, when said motor means is turned on, while exerting sufficient pressure on the incoming tape to keep it under proper tension to ensure adequate tightness in the resulting roll;

whereby a pile of loose tape can be automatically wound around said hub to form a tight roll that can be lifted away from the hub because of the slight inward slope of the outer side of said other post.

2. Tape winding means in accordance with claim 1 in which said tape deck is of round periphery.

3. Tape winding means in accordance with claim 2 in which said tape guide and tensioning means comprises a pair of tension rollers with vertically disposed axes, at least one of said rollers being mounted in a fixed position on said tape winding means, said tension rollers being positioned to receive said tape therebetween and exert said sufficient pressure thereon.

4. Tape winding means in accordance with claim 3 in which one of said pair of tension rollers is mounted on one end of a lever forming part of said tape guide and tensioning means and the latter includes spring means connecting the lever and a stationary part of said tape winding means so as to resiliently hold said one of said pair of tension rollers against the other roller during normal usage of the tape winding means, said tape guide and tensioning means including properly positioned pivot means for said lever whereby the lever can be manually controlled to swing said one of said pair of tension rollers out of contact with said other roller against the force of said spring means.

5. Tape winding means in accordance with claim 4 including annularly extending means at the top of one of said tension rollers to overlie the area of normal contact of the rollers and thereby prevent upward migration of the tape from its position between the rollers during operation of said tape winding means, said tape winding means also including a platform positioned adjacent the tape deck, and at the same level as the latter, said tension rollers being positioned substantially over said platform and closely adjacent the periphery of said tape deck.

6. Tape winding means in accordance with claim 5 in which said at least one of said hub posts includes all three of the hub posts.

7. Tape winding means in accordance with claim 6 in which said motor means comprises an electric motor and a drive shaft connecting said motor and said tape deck in direct drive relationship.

8. Tape winding means in accordance with claim 7 including a housing for said motor and in which said tape deck is positioned above said housing.

9. Tape winding means in accordance with claim 8 in which said tape deck is approximately 10½ inches in diameter.

10. Tape winding means in accordance with claim 9 in which said tape deck is formed from aluminum.

* * * * *